United States Patent [19]

Jennings, Jr.

[11] Patent Number: 4,844,158

[45] Date of Patent: Jul. 4, 1989

[54] SOLVENT STIMULATION OF VISCOUS OIL VIA A HORIZONTAL WELLBORE

[75] Inventor: Alfred R. Jennings, Jr., Plano, Tex.

[73] Assignee: Mobil Oil Corp., New York, N.Y.

[21] Appl. No.: 281,169

[22] Filed: Dec. 8, 1988

[51] Int. Cl.[4] ..... E21B 43/25; E21B 43/40

[52] U.S. Cl. ..... 166/267; 166/50; 166/305.1

[58] Field of Search ..... 166/50, 263, 266, 267, 166/273, 274, 305.1

[56] References Cited

U.S. PATENT DOCUMENTS

| | | | |
|---|---|---|---|
| 3,263,751 | 8/1966 | Kiel et al. | 166/305.1 X |
| 4,067,391 | 1/1978 | Dewell | 166/50 X |
| 4,160,481 | 7/1979 | Turk et al. | 166/50 X |
| 4,334,580 | 6/1982 | Vann | 166/50 X |
| 4,372,381 | 2/1983 | McMillen | 166/274 X |
| 4,373,585 | 2/1983 | Fitch et al. | 166/274 X |
| 4,465,138 | 8/1984 | Hunt, III | 166/267 X |
| 4,531,586 | 7/1985 | McMillen | 166/305.1 |

*Primary Examiner*—George A. Suchfield

*Attorney, Agent, or Firm*—Alexander J. McKillop; Charles J. Speciale; Charles A. Malone

[57] ABSTRACT

A two-step solvent stimulation method for producing heavy-oil from a formation wherein a horizontal wellbore is utilized. Said wellbore is filled with a solvent of a predetermined density. Next a displacement fluid having a density greater than said solvent is injected into the wellbore. Continued pumping of said displacement fluid causes the solvent having a lighter density to be displaced into said formation thereby enhancing the penetration of said solvent into the formation. Thereafter, pumping is terminated. Subsequently, the displacement fluid and solvent thinned heavy-oil are produced from said formation.

13 Claims, 1 Drawing Sheet

SOLVENT STIMULATION OF VISCOUS OIL VIA A HORIZONTAL WELLBORE

FIELD OF THE INVENTION

This invention is directed to a method for improving solvent stimulation of viscous hydrocarbonaceous fluids via a horizontal wellbore. More particularly, it is directed to the use of different densities of displacement fluids in a horizontal wellbore so as to permit a lighter density fluid to penetrate the formation to a greater extent.

BACKGROUND OF THE INVENTION

With advances in drilling technology, it is currently possible to drill horizontal wellbores deep into hydrocarbon producing reservoirs. Utilization of horizontal wellbores allows extended contact with a producing formation, thereby facilitating drainage and production of the reservoir.

Although horizontal wellbores allow more contact with the producing formation, some difficulties are encountered when horizontal wellbores are utilized which are not commonly experienced when vertical wells are used. Methods used in producing hydrocarbons from a formaton or reservoir via vertical wells often prove to be inefficient when attempting to remove hydrocarbons from a reservoir where horizontal wellbores are being used. This inefficiency results in utilization of increased amounts of fluids used during enhanced oil recovery operations. This results in a dimunition in the amount of hydrocarbons removed from the formation or reservoir.

Therefore, what is needed is an efficient solvent stimulation method of removing viscous hydrocarbonaceous fluids from a reservoir via a horizontal wellbore which will improve the production of hydrocarbons and minimize solvent usage.

SUMMARY

This invention is directed to a method for the stimulation of viscous oil from a formation which is penetrated by at least one horizontal wellbore. In the practice of this invention the wellbore is filled with a solvent such as xylene, toluene, diesel oil, or kerosene of a predetermined density. Afterwards, a second fluid having a density greater than the solvent is injected into the wellbore where it displaces upwardly said solvent from the wellbore and into the formation.

The displaced solvent penetrates and the formation and mixes with the viscous oil. Once the solvent has mixed with the viscous oil and the oil's viscosity reduced to the extent desired, injection of the second fluid is ceased. Thereafter, the fluids and oil of reduced viscosity are allowed to flow by gravity into the horizontal wellbore. From here the fluids along with the oil of reduced viscosity are produced to the surface. Upon reading the surface the fluids are separated from the viscous oil and are reinjected to the formation to recover additional viscous fluids.

It is therefore an object of this invention to increase the vertical relative permaebility of a formation in which a horizontal wellbore has been placed for the removal of hydrocarbonaceous fluids.

It is another object of this invention to use solvent stimulation in a formation containing a horizontal wellbore so as to optimize enhanced reservoir drainage via gravity.

It is yet another object of this invention to provide for solvent stimulation of a formation which stimulation can be used with any length of a horizontal wellbore.

It is a still yet further object of this invention to provide for a solvent stimulation method which can enhance oil recovery via a horizontal wellbore particularly in reservoirs having a low bottom hole pressure.

DESCRIPTION OF THE PREFERRED EMBODIMENTS

Figure 1:
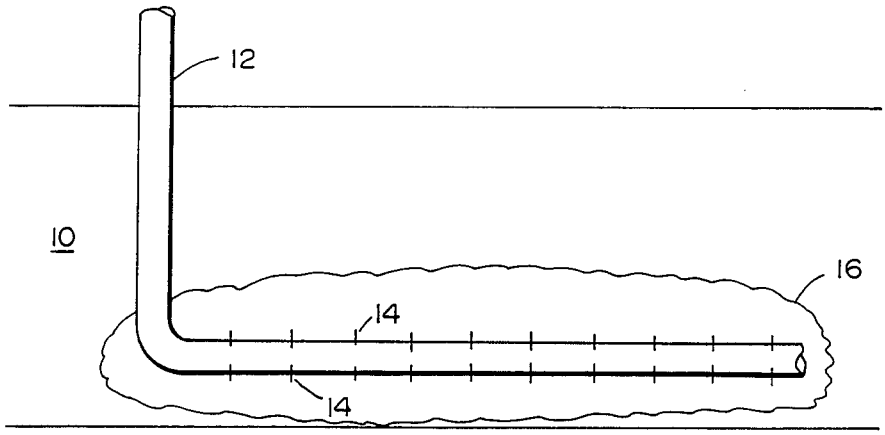
FIG. 1 is a schematic representation which depicts a horizontal wellbore in a formation subsequent to solvent injection.
Figure 2:
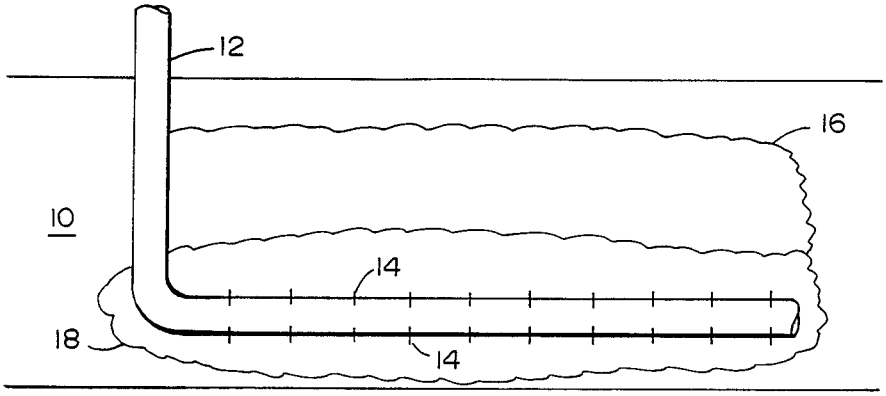
FIG. 2 is a schematic representation which depicts a formation containing solvent followed by a second denser fluid which has been directed through a horizontal wellbore.

In the practice of this invention as shown in FIG. 1, a horizontal wellbore 12 containing performations 14 is placed into viscous oil bearing formation 10. Because of the oil's high viscosity it will not freely flow into wellbore 12. To facilitate the oil's flow, a solvent 16 is placed into wellbore 12 and flows therefrom via perforations 14 into formation 10. Solvent 16 is placed into formation 10 in an amount sufficient to penetrate it to the extent desired. Solvent 16 is allowed to remove in the formation for a time sufficient to reduce the viscosity of the viscous oil so as to cause it to flow freely into wellbore 12. Since the solvent has a specific gravity or density less than that of the viscous oil, solvent 16 will preferentially tend to rise in formation 10 as it penetrates the formation and mixes with the viscous oil.

Once solvent 16 has penetrated formation 10 to the extent desired, a second displacement fluid 18 is injected into wellbore 12 where it enters formation 10 via perforations 14. Second displacement fluid 18 causes solvent 16 to preferentially rise and penetrate even further into formation 12. Additional displacement fluid 18 is injected into formation 10 until the solvent has penetrated it to the extent desired. When this occurs, injection of displacement fluid 18 is stopped. Once stopped, displacement fluid 18, along with solvent diluted viscous oil, is removed from formation 10 and produced to the surface.

Upon reaching the surface, displacement fluid 18 and solvent diluted oil are separated. Once separated, displacement fluid 18 and solvent 16 can be introduced into formation 10 to obtain additional hydrocarbonaceous fluids or viscous oil. Solvent introduction and second displacement fluid introduction can be continued until it becomes uneconomical to remove additional hydrocarbonaceous fluids from the formation. This invention works particularly well because the diluted viscous oil moves more efficiently into the horizontal wellbore because of gravity. Gravity acting on the viscous oil causes it to more readily fall into the wellbore for removal from the formation.

Suitable first fluids or solvents for injection into the formation include mixtures of hydrocarbons such as petroleum fractions as further exemplified by naphtha, gas oils, light crude oil, "cutter stock", a refinery product used for thinning fuel oil for ships, aromatic-containing condensates, mixed aromatic-paraffinic hydrocarbon materials as are sometimes available as a water stream in refinery operations, and mixtures thereof. In addition, said first displacement fluid can include saturated liquid hydrocarbons having from 2 to 10 carbon atoms in the molecules such as ethane, propane, or LPG, butane, pentane, hexane, cyclohexane octane, nonane, decane, and/or their mixtures with each other. Also, aromatic hydrocarbons such as benzene and aromatic fractions of petroleum distillates may be used or mixtures thereof. These hydrocarbons may also contain significant quantities of gas dissolved therein such as carbon dioxide which promote diffusion in the reservoir. These hydrocarbons are mentioned in U.S. Pat. No. 4,372,381 which issued to McMillen on Feb. 8, 1983. This patent is hereby incorporated by reference.

A higher density or higher specific gravity displacement fluid which may be used herein includes set water, brackish water, brine solutions and mixtures thereof. Listed below are some minimally required high density or high specific gravity solutions which can be used as a displacement fluid. The displacement fluid should have a specific gravity of at least 0.1 greater than the specific gravity of the solvent fluid. Although sodium chloride, potassium chloride, calcium chloride, and zinc chloride are mentioned in Table I, bromides of these salts may also be utilized. The specific gravity of the solvent can range from about 0.95 to about 1.20 at room temperature.

TABLE I

Examples of High Density Fluids

| Fluid | Concentration By Weight (%) | Specific Gravity @ 20° C. | Density Pounds Per Gallon @ 20° C. |
|---|---|---|---|
| NaCl | 2 | 1.0144 | 8.45 |
| NaCl | 4 | 1.0292 | 8.57 |
| NaCl | 8 | 1.0590 | 8.82 |
| NaCl | 12 | 1.0894 | 9.07 |
| NaCl | 26 (sat.) | 1.2025 | 10.02 |
| KCl | 2 | 1.0110 | 8.42 |
| KCl | 4 | 1.0239 | 8.53 |
| KCl | 8 | 1.0500 | 8.75 |
| KCl | 12 | 1.0768 | 8.97 |
| KCl | 24 (sat.) | 1.1623 | 9.68 |
| $CaCl_2$ | 2 | 1.0148 | 8.45 |
| $CaCl_2$ | 4 | 1.0316 | 8.59 |
| $CaCl_2$ | 8 | 1.0659 | 8.88 |
| $CaCl_2$ | 12 | 1.1015 | 9.18 |
| $CaCl_2$ | 40 (sat.) | 1.3957 | 11.63 |
| $ZnCl_2$ | 2 | 1.0167 | 8.47 |
| $ZnCl_2$ | 4 | 1.0350 | 8.62 |
| $ZnCl_2$ | 8 | 1.0715 | 8.93 |
| $ZnCl_2$ | 12 | 1.1085 | 9.23 |
| $ZnCl_2$ | 70 (sat.) | 1.9620 | 16.34 |

Once a cycle of a solvent and a displacement fluid has been moved through the formation so as to obtain hydrocarbonaceous fluids therefrom, the cycle can be repeated until it becomes uneconomical to remove additional hydrocarbonaceous fluids from the formation. A miscible displacement procedure using a water bank is disclosed in U.S. Pat. No. 3,270,809 which issued to Connally, Jr. et al. at Sept. 6, 1966. This patent is hereby incorporated in its entirety herein. The teachings of these procedures can be used in combination with this invention to place the fluids into the formation. Of course, as disclosed herein, horizontal wellbores must be used as taught along with the solvent and the displacement fluid.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A solvent stimulation method for producing viscous oil from a formation via at least one horizontal wellbore comprising:

(a) filling said horizontal wellbore with a first fluid which comprises a solvent of a predetermined density;

(b) injecting into said wellbore a second fluid having a density greater than the solvent which second fluid displaces upwardly said solvent from said wellbore causing it to penetrate into the formation;

(c) ceasing the injection of said second fluid and allowing said solvent to remain in contact with and penetrate the formation for a time sufficient to mix with the viscous oil thereby reducing its viscosity; and (d) producing said fluids and oil of reduced viscosity to the surface.

2. The method as recited in claim 1 where said solvent comprises xylene, toluene, diesel oil, or kerosene, and mixtures thereof.

3. The method as recited in claim 1 where said second fluid comprises sea water, brackish water, and mixtures thereof.

4. The method as recited in claim 1 wherein said second fluid is a member selected from the group consisting of aqueous solutions of potassium chloride, sodium chloride, calcium chloride, zinc bromide, potassium bromide, sodium bromide, calcium bromide, zinc bromide, and mixtures thereof.

5. The method as recited in claim 1 wherein said first fluid has a specific gravity range of from about 0.95 to about 1.20 at room temperature.

6. The method as recited in claim 1 where said second displacement fluid has a specific gravity of at least 0.1 greater than the specific gravity of the first displacement fluid.

7. The method as recited in claim 1 where the steps are repeated until the desired quantity of viscous oil has been removed from the formation.

8. The method as recited in claim 1 where the fluids produced from the formation are separated from the oil of reduced viscosity and recycled to recover viscous oil.

9. A solvent stimulation method for producing viscous oil from a formation via at least one horizontal wellbore comprising:

(a) filling said horizontal wellbore with a first fluid which comprises a solvent of a predetermined density selected from a member of the group consisting of xylene, toluene, diesel oil, or kersone;

(b) injecting into said wellbore a second fluid having a density greater than the solvent, which second fluid is a member selected from the group consisting of aqueous solutions of potassium chloride, sodium chloride, calcium chloride, zinc bromide, potassium bromide, sodium bromide, calcium bromide, zinc bromide and mixtures thereof;

(c) causing said second fluid to displace upwardly said solvent from the wellbore which causes the solvent to penetrate said formation and mix with the viscous oil;

(d) ceasing the injection of the second fluid and allowing said solvent remain in contact with the formation for a time sufficient to mix with the viscous oil thereby reducing its viscosity; and (e) removing by gravity said fluids and oil of reduced viscosity into said horizontal wellbore and producing them thereafter to the surface.

10. The method as recited in claim 9 wherein said first fluid has a specific gravity range of from about 0.95 to about 1.20 at room temperature.

11. The method as recited in claim 9 wherein said second displacement fluid has a specific gravity of at least 0.1 greater than the specific gravity of the first displacement fluid.

12. The method as recited in claim 9 where the steps are repeated until the desired quantity of vacious oil has been removed from the formation.

13. The method as recited in claim 9 where the fluids produced from the formation are separated from the oil of reduced viscosity and recycled to recover additional viscous oil.

* * * * *

UNITED STATES PATENT AND TRADEMARK OFFICE

CERTIFICATE OF CORRECTION

PATENT NO. : 4,844,158

DATED : July 4, 1989

INVENTOR(S) : Alfred R. Jennings, Jr.

It is certified that error appears in the above-identified patent and that said Letters Patent is hereby corrected as shown below:

Column 1, line 27, delete "formaton" and insert --formation--.
Column 1, line 52, delete "and" after "penetrates".
Column 1, line 60, delete "reading" and insert --reaching--.
Column 1, line 64, delete "permaebility" and insert --permeability--.
Column 2, line 30, delete "remove" and insert --remain--.
Column 2, line 68, delete "water" insert --waste--.
Column 3, line 16, delete "set" and insert --sea--.
Column 4, line 46, insert --additional-- after "recover".
Column 6, line 4, delete "vacious" and insert --viscous--.

Signed and Sealed this

Nineteenth Day of June, 1990

*Attest:*

*Attesting Officer*

HARRY F. MANBECK, JR.

*Commissioner of Patents and Trademarks*